United States Patent [19]

Kamiyama

[11] 4,161,866

[45] Jul. 24, 1979

[54] STIRLING CYCLE MACHINE

[75] Inventor: Shuichi Kamiyama, Tokyo, Japan

[73] Assignee: Aisin Seiki Kabushiki Kaisha, Kariya, Japan

[21] Appl. No.: 838,370

[22] Filed: Sep. 30, 1977

[51] Int. Cl.[2] ..... F02G 1/04

[52] U.S. Cl. ..... 60/517

[58] Field of Search ..... 60/517, 521, 522, 525, 60/526; 62/6

[56] References Cited

U.S. PATENT DOCUMENTS

| | | | |
|---|---|---|---|
| 3,568,436 | 3/1971 | Heffner | 60/517 |
| 3,848,877 | 11/1974 | Bengtsson | 60/517 |
| 4,080,788 | 3/1978 | Kantz | 60/517 |

FOREIGN PATENT DOCUMENTS

| | | | |
|---|---|---|---|
| 1288528 | 9/1972 | United Kingdom | 60/517 |

*Primary Examiner*—Allen M. Ostrager

*Attorney, Agent, or Firm*—Finnegan, Henderson, Farabow & Garrett

[57] ABSTRACT

A Stirling cycle machine comprises a plurality of cylinders and pistons disposed therein to define working chambers and working fluid refining means connected there with. The fluid refining means includes first compressors and at least one second compressor connected thereto for collecting the leaked working fluid from the working chambers and returning it to the working chambers.

12 Claims, 4 Drawing Figures

STIRLING CYCLE MACHINE

The present invention relates to a Stirling cycle machines which are useful as refrigerators, heat pumps and low temperature prime movers.

The Stirling cycle machines are known as being the machines in which repeated cycles of isothermal compression, isovolumetric change, isothermal expansion and isovolumetric change are performed in principle. For the purposes of performing such repeated cycles, the Stirling cycle machine has a closed circuit in whch helium, hydrogen, nitrogen or a mixture thereof is contained as a working fluid. The circulation of the working fluid in the closed circuit allows to operate the machine as a refrigerator, a heat pump, a prime mover, or a combination thereof.

Conventionally, in order to prevent the working fluid from leaking through sealing mechanisms in the Stirling cycle machines, particular means such as "rollsock seals" have been adopted. However, difficulties have been encountered in that the "rollsock" materials for the sealing mechanisms are deteriorated or damaged through prolonged period of time of the operation there of, resulting in various types of troubles. For example, such damage of the sealing materials not only causes a leakage of the working fluid from the working chambers but allows lubricant oil to enter working chambers to be mixed with the working fluid. Thus, there may be a significant decrease in the thermal efficiency and in some cases the machines may be accidentally stopped due to the excessive leakage of the working fluid. In conventional Stirling cycle machines, it has therefore been difficult to maintain a prolonged time of operation without any trouble.

It is therefore an object of the present invention to provide an improved Stirling cycle machine which has conventional sealing mechanisms and a novel working fluid pressure control system.

Another object of the present invention is to provide a Stirling cycle machine which can provide a high efficiency for a long period of time.

A further object of the present invention is to provide a Stirling cycle machine having a fulid circuit for refining leaked working fluid and returning it under desirable pressure to the working chambers.

According to the present invention, the above and other objects can be accomplished by a Stirling cycle machine comprising a rotatable shaft, a plurality of cylinders disposed around said shaft, a plurality of pistons respectively disposed in said cylinders for reciprocating movements so as to define working chambers for a Stirling cycle operation, means for connecting said pistons with said shaft so that the reciprocating movements of the pistons are interrelated with rotation of the shaft, a plurality of compressor means disposed adjacet to said shaft for collecting working fluid which has leaked from the working chambers through said pistons, fluid refining means connected with said compressor means to receive the working fluid collected thereby and refining it, and means for returning the working fluid under pressure to the working chambers.

The compressor means may comprise at least one compressor cylinder disposed in the radial direction with respect to the shaft, and at least one plunger disposed in said cylinder and adapted to be driven by cam means provided on the shaft. Alternatively, the plunger in the compressor means may be driven by one of said pistons. In such a case, the compressor cylinder should preferably be arranged in axial alignment with the piston.

The working fluid returning means may include compressor means and pressure reservoir means. The fluid refining means may include oil separating means for removing lubricant oil which may possibly be included in the collected working fluid.

In a preferable arrangement, the cylinders and the pistons for the Stirling cycle operation are arranged in parallel with and around the shaft, and the pistons are connected with the shaft through a swash disc. In such an arrangement, the compressor cylinder may conveniently be formed to extend in a radial direction with respect to the shaft.

In a more preferable arrangement of the Stirling cycle machine, the fluid refining and returning circuit may comprise a plurality of first compressor means for collecting the leaked working fluid of a relatively low pressure and increasing the pressure value to the predetermined level but below the pressure level of the working fluid in the Stirling cycle performing circuit, a buffer tank or reservoir means for receiving the working fluid from said first compressor means and the leaked working fluid from the working chambers of a relatively high pressure as compared with said first-mentioned leaked working fluid, a second compressor means connected to said buffer tank, and a working fluid refining means disposed between said second compressor and working chambers for Stirling cycle operation.

The above and other objects and features of the present invention will become apparent from the following descriptions of preferred embodiments taking reference to the accompanying drawings, in which.

Figure 1:
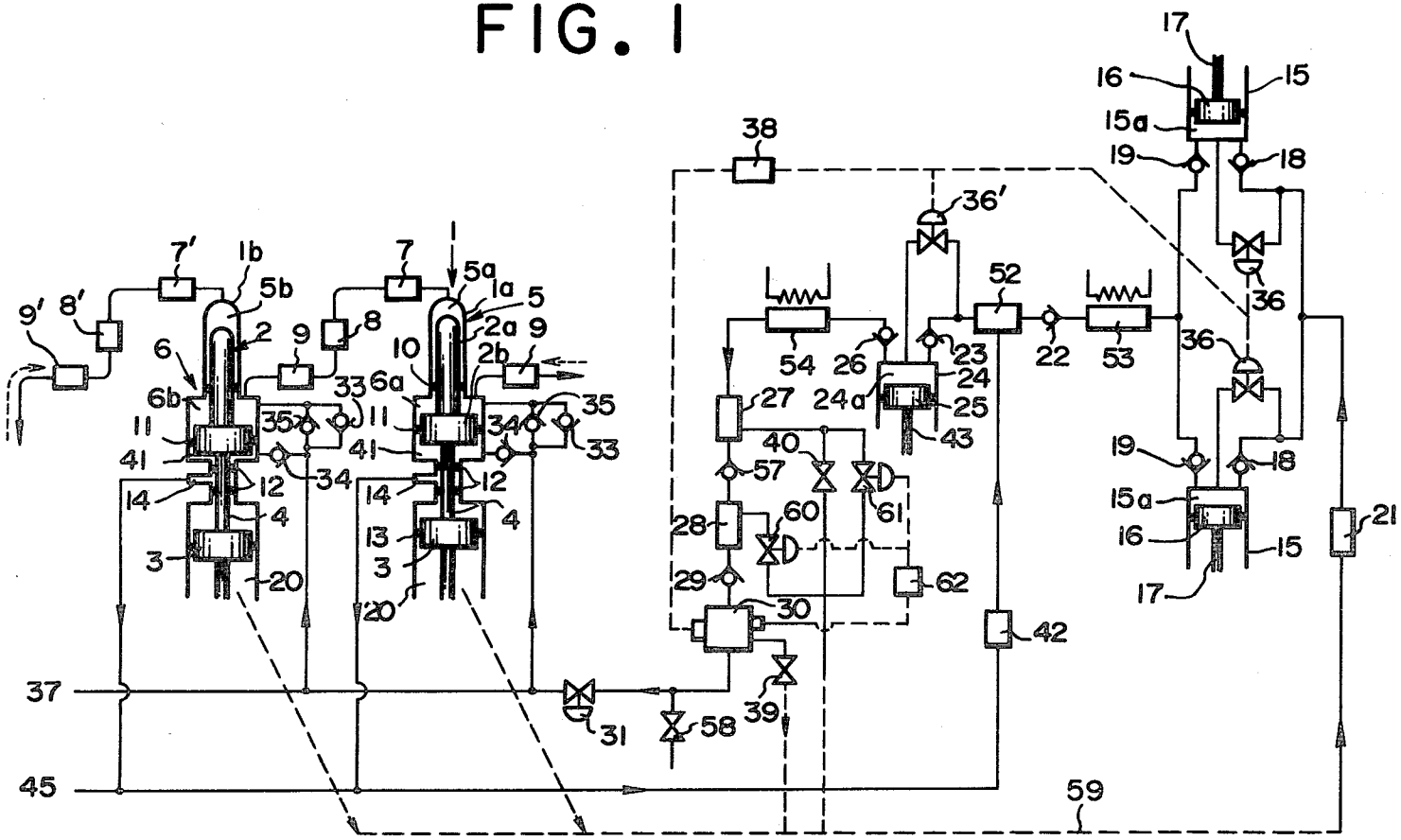
FIG. 1 is a circuit diagram of the fluid flow system in the Stirling cycle machine in accordance with the present invention.
Figure 2:
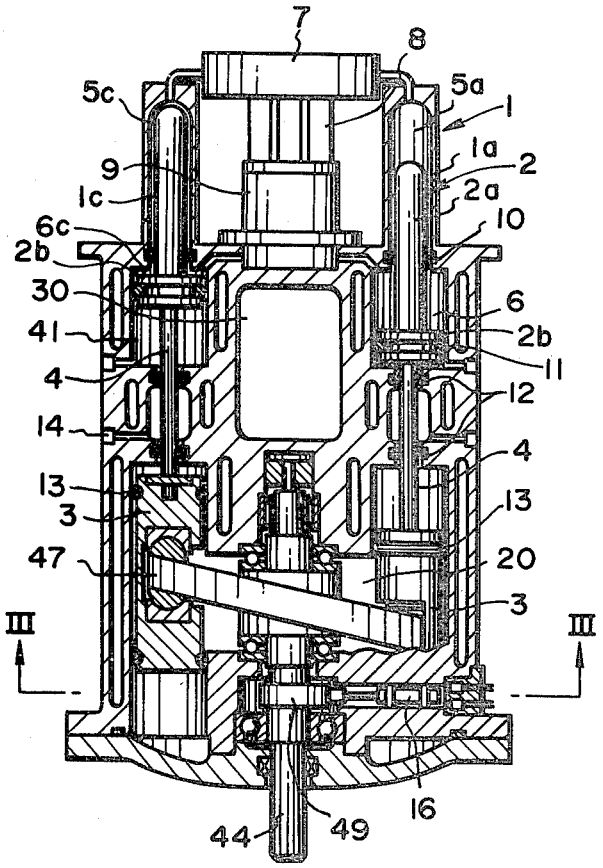
FIG. 2 is a sectional view of a main body of the Stirling cycle machine adopting the flow circuit shown in FIG. 1.

Referring now to the drawings, particularly to FIGS. 1 and 2, a Stirling cycle machine shown therein includes a plurality of stepped cylinders (1). For clear identification of individual cylinders, they are designated as 1*a*, 1*b*, 1*c* and so on. In each of the cylinders there is also disposed a stepped piston 2 for reciprocating movement. Thus, in the cylinders 1*a*, 1*b*, 1*c*, there are defined expansion chambers 5*a*, 5*b*, 5*c* and compression chambers 6*a*, 6*b*, 6*c*. Each piston 2 has a small diameter portion 2*a* and a large diameter portion 2*b* which are integrally formed and of which large diameter portion 2*b* is connected through a connecting rod 4 with a guide piston 3. The guide piston 3 is disposed to reciprocate in a cylinder bore.

It will be understood in FIG. 2 that the cylinders 1 and the pistons 2 are arranged in parallel to each other along a circle and the guide pistons 3 are engaged with a swash plate 47 which co-operates with a rotatable shaft 44. Thus, the guide pistons 3 and the pistons 2 are reciprocated in response to the rotation of the shaft 44. Any number not less than three of the cylinder-piston combinations may be provided at angularly spaced equi-distant positions.

The expansion chamber 5a in the cylinder 1a is connected through a heat absorber 7, a regenerator 8 and a radiator 9 with the compression chamber 6b in the adjacent cylinder 1b. Similarly, the expansion chamber 5b in the cylinder 1b is connected with the compression chamber 6c in the next cylinder 1c through a heat absorber 7', a regenerator 8' and a radiator 9'. In case of a three-cylinders arrangement, the expansion chamber 5c of the cylinder 1c is connected with the compression chamber 6a of the cylinder 1a. In this case, the pistons 2 are operated with 120° phase difference.

The expansion chambers and the compression chambers as well as the lines connecting them together are filled with a working fluid such as helium, hydrogen, nitrogen or mixture thereof. When the machine is used as a refrigerator, the shaft 44 is driven by an appropriate power source (not shown) so that the guide pistons 3 and therefore the pistons 2 are reciprocatingly moved. The working fluid in the compression chamber 6b which is in compression stroke is compressed. Since the working fluid is cooled by the radiator 9, the compression is performed in an isothermal manner. Then, the working fluid is passed through the regenerator 8 and the heat absorber 7 into the expansion chamber 5a in an isovolumetric manner. Then, the expansion chamber 5a starts to expand and the fluid in this chamber 5a expands in an isothermal manner. The heat absorber 7 then absorbs heat so that the machine functions as a refrigerator. The fluid expanded in the chamber 5a is isovolumetrically returned through the heat absorber 7, the regenerator 8 and the radiator 9 to the compression chamber 6b.

When the heat absorber 7 is heated, the radiator 9 produces a heat so that the machine functions as a heat pump. The heat cycle adopted in this machine is reversible so that the machine can be operated as a prime mover wherein this power can be taken out through the shaft 44. For this purpose, the heat absorber 7 is heated by means of combustion gas or steam. Further, by operating the chambers 6 as expansion chambers and the chambers 5 as compression chambers, and by cooling the heat absorber 7 with liquified natural gas or liquified hydrogen and heating the radiators 9 by steam or hot water, the machine can be used as a cryogenic engine.

Behind each of the pistons 2, there is defined in the cylinder 1 a back pressure chamber 41 which is filled with working fluid under pressure. The fluid pressure in the back pressure chamber 41 functions to counterbalance the pressure applied to the piston 2 by the fluid in the chambers 5 and 6. The small diameter portion 2a of the piston 2 is encircled by a seal ring 10 to provide a gastight seal between the chambers 5 and 6. Further, the piston 2 is also provided at the large diameter portion 2b with a piston ring 11.

Each connecting rod 4 has a pair of axially spaced seal rings 12 and the working fluid which has leaked from the back pressure chamber 41 is taken out through a port 14. As shown in FIG. 1, the ports 14 are connected with a line 45 which leads through a pressure regulator 42 to a fluid reservoir 52. The guide pistons 3 and the swash plate 47 are disposed in a chamber 20 in a driving case. The chamber 20 in the driving case is connected with a line 59 which leads through a strainer 21 and check valves 18 to a pair of compressor cylinder bores 15. In the chamber 20 in the driving case the working fluid is leaked through the seal rings 12, 13. The pressure in the line 59 is relatively low as compared with the pressure in the line 45.

Figure 3:
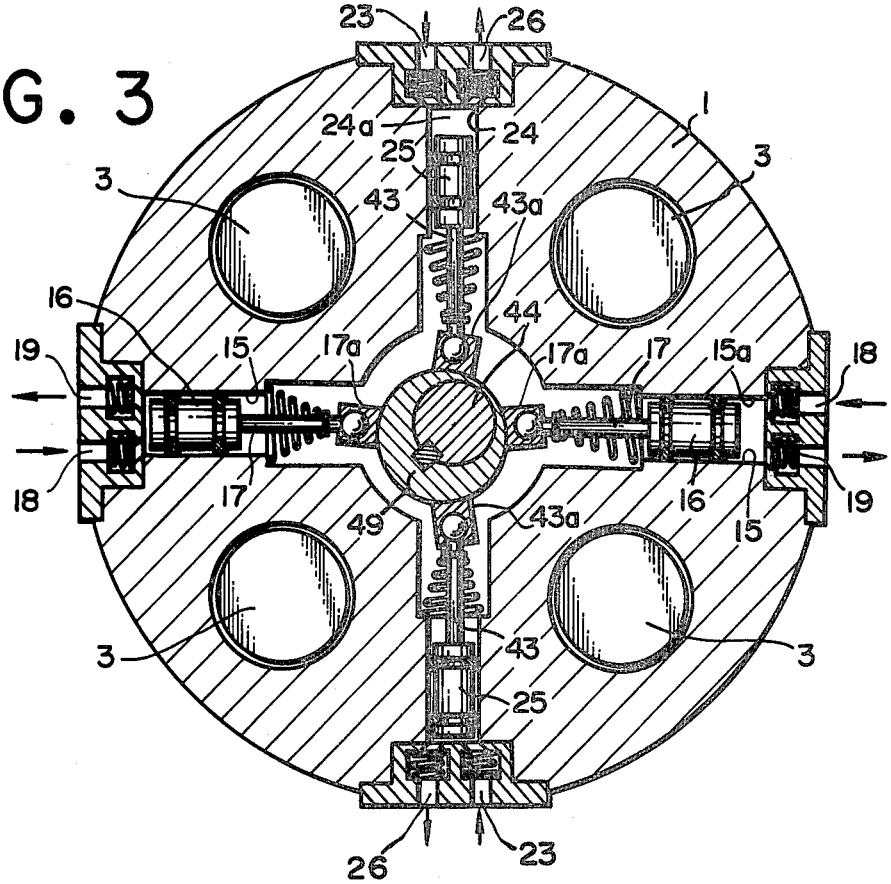
FIG. 3 is a cross-sectional view of the Stirling cycle machine taken substantially along the line III—III in FIG. 2.

As shown in FIGS. 2 and 3, the compressor cylinders are formed in radially opposed relationship and a plunger 16 is slidably received in each of the cylinders 15. The plunger 16 has a plunger rod 17 which rides at its free end through a cam foflower 17a on a cam 49 provided on the shaft 44. Thus, a compressor chamber 15a is formed at the radially outer end portion of each cylinder 15 and connected through the line 59. Each of the compressor chambers 15a is also provided with an outlet line having a check valve 19 which is connected through a fluid cooler 53 and a check valve 22 with the fluid reservoir 52.

As shown in FIG. 3, a further pair of pump cylinder bores 24 are formed in radially opposed relationship. In each of the cylinder bores 24, there is disposed a compressor plunger 25 which has a plunger rod 43 adapted to engage through a cam follower 43a with the cam 49. A compressor chamber 24a is thus defined in the outer end of each cylinder bore 24. Each of chambers 24a is connected through an inlet check valve 23 with the fluid reservoir 52 to receive fluid therefrom. Each of chambers 24a further has an outlet check valve 26 which is connected through a fluid cooler 54 with an oil separator 27. The oil separator 27 is connected through a check valve 57 with a fluid refining device 28 which is in turn connected through a check valve 29 with a fluid reservoir 30.

An unloader valve 36 is provided in a line bypassing each of the check valves 18. Similarly, an unloader valve 36' is provided in a line bypassing each check valve 23. Also, an unloader control device 38 is provided so as to receive fluid pressure from the fluid reservoir 30 and functions to open the unloader valves 36 and 36' when the pressure in the fluid reservoir 30 reaches a predetermined value so as to decrease the load on the power source.

The fluid reservoir 30 is connected with a control valve 31 which is in turn connected through check valves 33 with the chambers 6 and through check valves 34 with the chamber 41. A safety valve 35 is provided in a line bypassing the check valve 33 as shown in FIG. 1. The fluid reservoir 30 is provided with a safety relief valve 39 for relieving fluid to the lower pressure line when the pressure in the reservoir 30 exceed a predetermined value.

In lieu of the unloader control device 38 and the unloader valves 36 and 36', the fluid refining device 28 and the oil separator 27 may be provided with control valves 60 and 61, respectively, which are controlled by a control device 62 so that they are opened when the fluid pressure in the reservoir 30 exceeds the aforementioned predetermined value for relieving the high pressure fluid from the fluid refining device 28 and the oil separator 27 to the low pressure side, that is, the chamber 20 in the driving case for the guide pistons 3. This arrangement is advantageous in that the separated oil is splashed from the separator 27 and the oil refining device 28 when the high pressure fluid is relieved.

Figure 4:
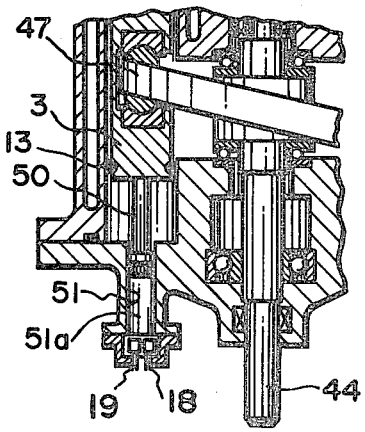
FIG. 4 is a fragmentary sectional view showing another embodiment of the present invention.

Referring now to FIG. 4, there is provided a compressor cylinder bore 51 which is axially aligned with one of the cylinder bores for the guide pistons 3. The guide piston 3 has a plunger 50 secured thereto or integrally formed therewith. Thus, a compressor chamber 51a is defined in the cylinder bore 51. The compression chamber 51a is provided with the inlet check valve 18. The compressor chamber 51a is also provided with the outlet check valve 19 which is connected through the fluid cooler 53 and the check valve 22 with the reservoir 52.

From the above descriptions, it will be understood that in accordance with the present invention the working fluid can be always maintained under high pressure and under high purity. Even if there is any fluid leakage from the working chamber when the machine is inoperative, such pressure loss can be compensated for by the pressure from the reservoir. Therefore, the machine can start its function as soon as it is restarted. Since the chamber in the driving case for the guide pistons and the swash plate are maintained under low pressure due to the existence of the compressors, there is less possibility of fluid leakage to the atmosphere and the thickness and the weight of the driving case can be considerably reduced. The compressors are totally housed in the machine block so that the driving mechanisms for the pumps are greatly simplified.

Further, the seal mechanisms to be used in the Stirling machine allow the working fluid to be leaked to the extent that the operation of the machine is normally effected, and thus the contact pressure of the seal mechanisms is decreased and the life times thereof are greatly extended.

The invention has thus been shown and described with reference to specific embodiments, however, the invention is in no way limited to the details of the illustrated structures but changes and modifications may be made without departing from the scope of the appended claims.

I claim:

1. A Stirling cycle machine comprising a rotatable shaft, a plurality of cylinders disposed around said shaft, a plurality of pistons respectively disposed in said cylinders for reciprocating movements so as to define working chambers for a Stirling cycle operation, means for connecting said pistons with said shaft so that the reciprocating movements of the pistons are interrelated with rotation of the shaft, a plurality of compressor means disposed adjacent to said shaft for collecting working fluid which has leaked from the working chambers past said pistons, a portion of said leaked working fluid being at a higher pressure than the remaining lower pressure portion, said plurality of compressor means adapted to be driven by said connected pistons and shaft, fluid refining means connected with said compressor means to receive the working fluid collected thereby and refine it, and means for returning the working fluid under pressure to the working chambers.

2. A Stirling cycle machine in accordance with claim 1 in which said plurality of compressor means includes at least one compressor cylinder disposed in the radial direction with respect to the shaft, and at least one plunger disposed in said compressor cylinder and adapted to be driven by cam means provided on the shaft.

3. A Stirling cycle machine in accordance with claim 1 in which said plurality of compressor means includes a pair of compressors operating in parallel, said pair of compressors including a pair of compressor cylinders disposed in the radial direction with respect to the shaft, and a pair of plungers respectively disposed in said pair of compressor cylinders and adapted to be driven by cam means provided on the shaft.

4. A Stirling cycle machine in accordance with claim 1 in which said plurality of compressor means includes at least one compressor cylinder disposed in the axial direction in axial alignment with one of said pistons and at least one plunger disposed in said at least one compressor cylinder and adpated to be driven by said one piston.

5. A Stirling cycle machine in accordance with claim 1 in which said working fluid returning means includes pressure reservoir means.

6. A Stirling cycle machine in accordance with claim 1 in which said fluid refining means includes oil separator means for removing lubricant oil carried by the leaked working fluid.

7. A Stirling cycle machine comprising a rotatable shaft, a plurality of cylinders disposed around said shaft, a plurlity of pistons respectively disposed in said cylinders for reciprocating movements so as to define working chambers for a Stirling cycle operation, means for connecting said pistons with said shaft so that rotation of said shaft is interrelated with the movements of said pistons, said working chambers defined in each cylinder including an expansion chamber and a compression chamber which is connected through a radiator, a regenerator, and a heat absorber to the expansion chamber formed in the adjacent cylinder, a driving case located opposite said working chambers, said driving case having a chamber, a plurality of compressor means including a plurality of first compressors for receiving and compressing low pressure working fluid which has leaked from the working chambers into said driving case chamber, fluid reservoir means for receiving the leaked working fluid collected by said plurality of first compressors, said fluid reservoir means also receiving high pressure working fluid leaked from the working chambers past said pistons, said plurality of compressor means also including at least one second compressor for receiving the working fluid from said fluid reservoir, fluid refining means connected with said second compressor for receiving the working fluid collected thereby and refining it, and means for returning the working fluid under pressure from the fluid refining means to the working chambers.

8. A Stirling cycle machine in accordance with claim 7 in which said fluid returning means includes fluid reservoir means provided between the fluid refining means and the working chambers, and means for controlling the pressure in said fluid reservoir means.

9. A Stirling cycle machine in accordance with claim 7 in which said plurality of compressor means includes at least one compressor cylinder disposed in the radial direction with respect to the shaft, and at least one plunger disposed in said compressor cylinder and adapted to be driven by cam means provided on the shaft.

10. A Stirling cycle machine in accordance with claim 7 in which said plurality of compressor means includes a pair of compressors operating in parallel, said pair of compressors including a pair of compressor cylinders disposed in the radial direction with respect to the shaft, and a pair of plungers respectively disposed in said compressor cylinders and adapted to be driven by cam means provided on the shaft.

11. A Stirling cycle machine in accordance with claim 7 in which said plurality of compressor means includes at least one compressor cylinder disposed in the axial direction in axial alignment with one of said pistons and at least one plunger disposed in said compressor cylinder and adapted to be driven by said one piston.

12. A Stirling cycle machine in accordance with claim 7 further comprising an unloader control device for receiving fluid pressure from the fluid reservoir means and for discharging the collected working fluid from said reservoir to said driving case chamber when the pressure reaches a predetermined value.

* * * * *